United States Patent [19]

Wilson

[11] Patent Number: 4,884,600

[45] Date of Patent: Dec. 5, 1989

[54] OIL NOZZLE APPARATUS AND METHOD

[76] Inventor: Ronald J. Wilson, 2239 E. Clarendon, Phoenix, Ariz. 85016

[21] Appl. No.: 273,841

[22] Filed: Nov. 21, 1988

Related U.S. Application Data

[63] Continuation of Ser. No. 90,949, Aug. 28, 1987, abandoned.

[51] Int. Cl.[4] ..... B65B 39/00; B65C 11/00

[52] U.S. Cl. ..... 141/1; 141/320; 141/335; 141/352; 141/354; 222/566; 222/559; 222/631

[58] Field of Search ..... 141/1, 319–322, 141/335–336, 344, 345, 351–356, 360–362, 392; 220/288, 375; 215/306; 222/631, 634, 509, 525, 559, 566, 567

[56] References Cited

U.S. PATENT DOCUMENTS

| | | | |
|---|---|---|---|
| 573,333 | 12/1896 | Krimmel | 220/86 R X |
| 1,638,446 | 8/1927 | LeBel | 141/335 |
| 1,673,810 | 6/1928 | Dewire | 220/288 X |
| 2,593,634 | 4/1952 | Vosburg | 222/525 |
| 2,701,078 | 2/1955 | Bowman | 141/321 |
| 3,074,444 | 1/1963 | Hawksford | 141/353 |
| 3,181,725 | 5/1965 | Friedl | 220/375 X |
| 3,289,712 | 12/1966 | Smith | 141/352 |
| 3,525,366 | 8/1970 | DeFrees | 220/288 X |
| 4,706,720 | 11/1987 | Pattison et al. | 141/327 |

FOREIGN PATENT DOCUMENTS

| | | | |
|---|---|---|---|
| 760330 | 2/1934 | France | 215/305 |
| 1179560 | 5/1959 | France | 141/335 |
| 47394 | 6/1909 | Switzerland | 141/335 |
| 368214 | 3/1932 | United Kingdom | 141/335 |
| 371679 | 4/1932 | United Kingdom | 215/305 |
| 2170121 | 7/1986 | United Kingdom | 141/335 |

*Primary Examiner*—Ernest G. Cusick
*Attorney, Agent, or Firm*—LaValle D. Ptak

[57] ABSTRACT

An oil nozzle allows for oil to be poured into an engine without the spillage and waste commonly accompanying oil pouring from conventional threaded containers. By use of the tightening member a threaded oil container is attached to the oil nozzle in its closed position and positioned on top of an oil receiving port of an engine. The oil container is pushed downward which opens the oil nozzle and allows oil flow from the container into the oil port. After a desired amount of oil has been dispensed, downward pressure is applied to the shut-off handle which seals the nozzle in its closed position.

18 Claims, 1 Drawing Sheet

OIL NOZZLE APPARATUS AND METHOD

This is a continuation of application Ser. No. 07/090,949, filed Aug. 28, 1987, now abandoned.

BACKGROUND OF THE INVENTION

1. Field of the Invention

The present invention generally relates to an improved oil nozzle and, more specifically, to an oil nozzle which dispenses a desired amount of oil from a conventional plastic oil container into an engine oil receiving port without spillage.

2. Description of the Prior Art

Recently, motor oil for automobiles has been packaged in plastic bottles with threaded necks and cooperatively threaded resealable caps. The oil from these containers can be poured directly into the oil receiving port of the engine. Due to the awkward location of the oil receiving ports in most automobiles, oil often spills over the rest of the engine when poured directly from the bottle, creating undesirable waste and mess. Ordinary funnels are often used in attempt to alleviate this problem. However an ordinary funnel does not control the starting and stopping of the flow of oil into the port, so any funnel overflow further complicates the problems. Additionally, the user's hands must come in contact with the oil container neck, preventing the user from maintaining clean hands during the oil dispensing process.

Accordingly, there is a distinct need for an improved oil nozzle which eliminates the afore-mentioned problems associated with pouring oil from plastic bottles into the oil receiving ports of automobile engines.

SUMMARY OF THE INVENTION

It is an object of this invention to provide an improved oil nozzle apparatus.

It is a further object of this invention to provide an oil nozzle apparatus which effectively allows for the pouring of a desired amount of oil from plastic oil bottles into the oil receiving port of an engine without spillage.

It is a still further object of this invention to provide an improved oil nozzle apparatus which is drip-free and which can accommodate different sized oil receiving ports on engines through the use of a detachable funnel-shaped spout.

It is another object of the present invention to provide an improved oil nozzle apparatus which allows the user to control the stopping and starting of the oil flow without touching any portion of the nozzle apparatus or oil container which contacts the oil.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENT

Figure 1:
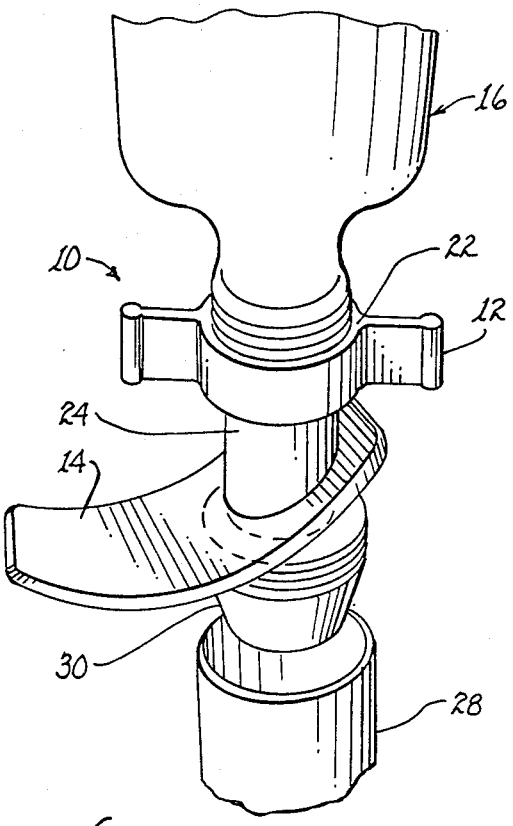
FIG. 1 is a perspective view of the improved oil nozzle as attached to an oil container and located above an oil receiving port.

Referring now to FIG. 1 of the accompanying drawings which set forth the present invention in greater detail and in which like numerals designate like features, an improved oil nozzle apparatus 10 is generally comprised of a receiving end portion 22, a tightening member 12, a hollow tubular member 24, a shut-off handle member 14, and a ring member 30. The receiving end portion 22 is threaded so as to provide means for detachably coupling with the oil container 16. The tightening member 12 provides a means by which the receiving end portion 22 can be gripped and easily twisted onto the oil container 16.

Figure 2:
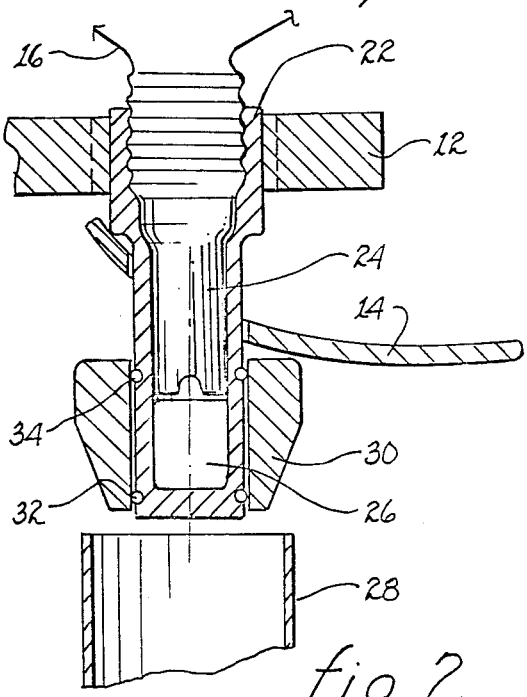
FIG. 2 is a cross sectional view of the subject invention with the oil nozzle shown in a closed position.

As seen in FIG. 2, the hollow tubular member 24 provides outlet means 26 at the lower end of the tubular member 24 for dispensing oil into an oil receiving port 28. The shut-off handle member 14 is curved at an angle such that a minimal downward pressure is sufficient to slide the ring member 30 down the length of the tubular member 24, thereby sealing the outlet means 26 in a closed position. The ring member 30 is positioned to contact an upper o-ring 34 and a lower o-ring 32, both which are circumferentially oriented and coupled with the tubular member 24. The o-rings 32 and 34 may be replaceable and separate from the hollow member 24 or may be integral therewith. When the ring member 30 is in contact with the o-rings 32 and 34, the outlet means 26 are completely sealed so that oil is not allowed to flow out of the nozzle. A lower portion of the ring member 30 is frustro-conical in shape so that it can taper fit into the oil receiving port 28 of the engine.

Figure 4:
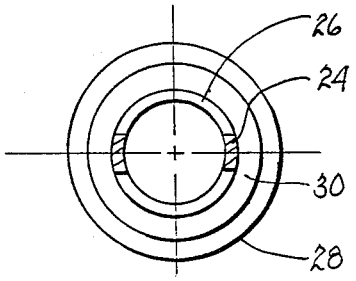
FIG. 4 is a cross sectional view taken along line 4—4 of FIG. 3 in the direction of the arrows.
Figure 3:
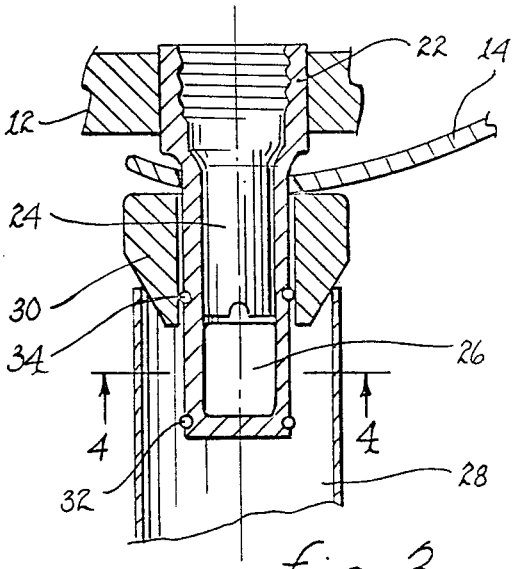
FIG. 3 is a cross sectional view of the present invention with the oil nozzle shown in an open position.

As depicted in FIG. 3, when the ring member 30 is positioned to uncover the outlet means 26 (one shown), oil is allowed to flow into the oil receiving port 28. Two outlet means 26 are shown in FIG. 4.

Figure 5:
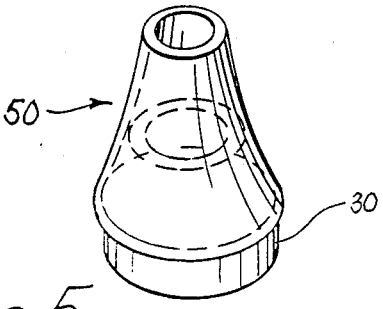
FIG. 5 is a perspective view of the detachable funnel-shaped spout.

Illustrated in FIG. 5 is the detachable funnel-shaped spout 50 which can be operably coupled with the nozzle apparatus 10. The funnel-shaped spout 50 can vary in size to accommodate a different sized engine oil receiving port 28 with similar ease of use and lack of spillage.

Figure 6:
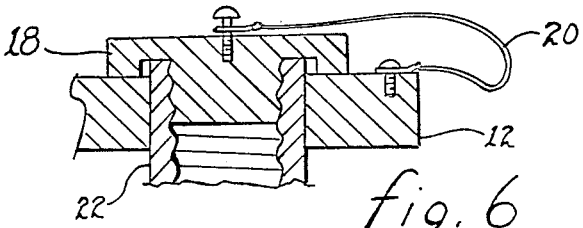
FIG. 6 is a cross sectional view of the dust cap in a deployed position.

Referring now to FIG. 6, a detachable dust cap 18 prevents particulates from entering the interior portions of the nozzle 10. The dust cap 18 is employed when the nozzle 10 is not attached to an oil container 16, and may be threadably (as shown) or frictionally (not shown) coupled with the receiving end portion 22. A flexible cap holding member 20 connectively couples the dust cap 18 with an exterior portion of the receiving end 22 thereby preventing loss of the dust cap 18 when it is not employed.

SYSTEM OPERATION

The tightening member 12 is used to assist in attaching the oil container 16 onto the receiving end portion 22 while the oil container is in an upright position and the oil nozzle 10 is in the closed position. The oil container 16, along with the oil nozzle 10, is then inverted.

In FIG. 2, the oil nozzle is shown in its closed position, ready for insertion. The oil nozzle 10 is positioned above the oil receiving port 28 and then pressed downward into the port 28, pushing the oil nozzle 10 into an open position.

FIG. 3 shows the nozzle 10 in its open position, after insertion. Oil can freely flow from the oil container 16, down the hollow tubular member 24, through outlet means 26, and into the oil receiving port 28. After the desired amount of oil has been dispensed, the shut-off handle means 14 is pressed downward, which in turn through a camming action between the ring member 30 and a shoulder formed between the bottom of the receiving end portion 22 and the tubular member 24, pushes the ring member 30 down the length of the hollow tubular member 24. The o-rings 32 and 34 contact the ring member 30 to seal both the upper and the lower ends of the outlet means 26 at the same time. The oil nozzle apparatus 10 can now be lifted off the oil receiving port 28 without spillage.

The detachable funnel-shaped spout 50 can be attached to the nozzle apparatus 10 to accommodate any diameter of oil receiving port 28.

While the invention has been particularly shown and described in reference to the preferred embodiments thereof, it will be understood by those skilled in the art that changes in form and details may be made without departing from the spirit and scope of the invention.

I claim:

1. An improved oil nozzle apparatus for dispensing oil from an oil container comprising:

receiving end means adapted for detachably coupling said oil nozzle apparatus with said oil container, said receiving end means having a predetermined diameter;

hollow tubular member means having an upper end and a lower end, with the upper end operably coupled with said receiving end means for accommodating a flow of said oil, said hollow tubular member means having an outer diameter less than said predetermined diameter to form a shoulder between said receiving end means and said hollow tubular member means;

outlet means positioned on an outer circumference of the lower end of said tubular member means adapted for dispensing said oil into an oil receiving port;

ring member means slidably coupled with the outside of said hollow tubular member means and movable between upper and lower positions for controlling said flow of oil through said outlet means; and manually operated shut-off handle means mounted on said hollow tubular member means of said oil nozzle apparatus between said receiving end means and said ring member means for sliding said ring member means from the upper position thereof to the lower position thereof through a camming action by pressing said handle means against said shoulder and against said ring member means to seal said outlet means in a closed position after a desired amount of oil has been dispensed from said oil container.

2. An improved oil nozzle in accordance with claim 1 further comprising detachable funnel-shaped spout means operably coupled to said nozzle apparatus adapted for accommodating engine oil ports of various sizes and locations.

3. An improved oil nozzle in accordance with claim 2 wherein said detachable funnel shaped spout means is designed to accommodate variances in the diameter of said oil receiving port.

4. An improved oil nozzle in accordance with claim 1 further comprising tightening member means adapted for gripping and twisting said oil nozzle receiving end means onto said oil container.

5. An improved oil nozzle in accordance with claim 1 further comprising said receiving end means having an open end and comprising cap means detachably coupled with said receiving end means for operably sealing said open end.

6. An improved oil nozzle in accordance with claim 5 further comprising cap holding means operably coupled with said cap means and an exterior portion of said receiving end means for maintaining said cap means therewith when said cap means is decoupled from said open end.

7. An improved oil nozzle in accordance with claim 1 wherein said hollow tubular member has an upper o-ring member means and a lower o-ring member means cooperating with said ring member means for sealing said outlet means.

8. An improved oil nozzle in accordance with claim 1 wherein a lower portion of said ring member means is frustroconically shaped.

9. An improved oil nozzle in accordance with claim 1 wherein said shut-off handle means is curved at an angle to allow sealing of said outlet means wtih a minimal application of pressure.

10. A method of dispensing oil from an oil container through an improved oil nozzle apparatus comprising the steps of:

providing receiving end means for detachably coupling said oil nozzle apparatus with said oil container;

providing tubular member means operably coupled with said receiving end means for accommodating a flow of said oil;

providing outlet means at a lower end of said tubular member means for dispensing said oil into an oil receiving port;

providing ring member means slidably coupled with said hollow tubular member means for controlling said flow of oil through said outlet means;

providing shut-off handle means operably coupled with said oil nozzle apparatus for sliding said ring member means to seal said outlet means in a closed position;

coupling said oil nozzle apparatus with said oil container;

inverting said oil container;

exerting downward pressure on said oil container to slide said ring member means into a position to allow said flow of oil into an engine; and thereafter exerting downward pressure on said shut-off handle means to stop said flow of oil.

11. A method of dispensing oil in accordance with claim 10 further comprising the step of providing detachable funnel-shaped spout means operably coupled to said oil nozzle apparatus for accommodating engine oil ports of various sizes and locations.

12. A method of dispensing oil in accordance with claim 11 wherein said detachable funnel-shaped spout means is designed as to accommodate variances in the diameter of said oil receiving port.

13. A method of dispensing oil in accordance with claim 10 further comprising the step of providing tightening member means for gripping and twisting said receiving end means onto said oil container.

14. A method of dispensing oil in accordance with claim 10 further comprising said receiving end means having an open end and comprising the step of providing cap means detachably coupled with said receiving end means for operably sealing said open end.

15. A method of dispensing oil in accordance with claim 14 further comprising the step of providing cap holding means operably coupled with said cap means and an exterior portion of said receiving end means for maintaining said cap means therewith when said cap means is decoupled from said open end.

16. A method of dispensing oil in accordance with claim 10 wherein said hollow tubular member has an upper o-ring member means and a lower o-ring member means cooperating with the ring member means for sealing said outlet means.

17. A method of dispensing oil in accordance with claim 10 wherein a lower portion of said ring member means is frustoconically shaped.

18. A method of dispensing oil in accordance with claim 10 wherein said shut-off handle means is curved at an angle to allow sealing of said outlet means with a minimal application of pressure.

* * * * *